US007338045B2

(12) United States Patent
Guha

(10) Patent No.: US 7,338,045 B2
(45) Date of Patent: Mar. 4, 2008

(54) THREE DIMENSIONAL MAZE GAME

(76) Inventor: Dwipendra Nath Guha, 50-B, Turf Road, Calcutta 700 025 (IN)

( * ) Notice: Subject to any disclaimer, the term of this patent is extended or adjusted under 35 U.S.C. 154(b) by 0 days.

(21) Appl. No.: 10/533,789

(22) PCT Filed: Nov. 4, 2003

(86) PCT No.: PCT/IN03/00352

§ 371 (c)(1),
(2), (4) Date: May 4, 2005

(87) PCT Pub. No.: WO2004/041378

PCT Pub. Date: May 21, 2004

(65) Prior Publication Data

US 2006/0012119 A1 Jan. 19, 2006

(30) Foreign Application Priority Data

Nov. 5, 2002 (IN) ..... 621/02

(51) Int. Cl.
*A63F 7/04* (2006.01)

(52) U.S. Cl. ..... 273/153 R; 273/109

(58) Field of Classification Search ..... 273/153 R, 273/108, 118 R, 109, 115–117, 123 R, 153 S
See application file for complete search history.

(56) References Cited

U.S. PATENT DOCUMENTS 2,509,340 A * 5/1950 Fly ..... 273/109
3,406,971 A 10/1968 Koff
3,689,074 A 9/1972 Benton et al.
3,787,054 A * 1/1974 Stafford ..... 273/109
4,005,865 A 2/1977 Kidder
4,008,895 A * 2/1977 Reiner et al. ..... 273/113
4,494,753 A * 1/1985 Wampler ..... 273/113
4,545,577 A 10/1985 Randleman
4,861,036 A * 8/1989 Watanabe ..... 273/113

(Continued)

FOREIGN PATENT DOCUMENTS

DE 8702087 8/1987

(Continued)

OTHER PUBLICATIONS

Brumme, I, International Search Report for PCT/IN 03/00352, May 21, 2004.

*Primary Examiner*—Raleigh W. Chiu
(74) *Attorney, Agent, or Firm*—Lau & Associates

(57) ABSTRACT

A three-dimensional maze game in the form of a hand-held toy. The hand held toy is in the form of a cube. The toy comprises a substantially cubic non-transparent body containing a plurality of intersecting pathways for an object and an entrance aperture and single/multiple exit apertures connecting the pathways wherein each intersection formed by the intersecting pathways is provided with means to bring the object to rest till the toy is tilted and the object follows a vertical pathway that is defined by the tilting of the toy. The object is inserted into an entry point in the toy and the player has to bring the object out through an exit point by following a fixed number of steps in turning the toy. The challenge is to find the correct sequence of turns and considerable amount of mental dexterity is required for the purpose.

14 Claims, 3 Drawing Sheets

U.S. PATENT DOCUMENTS

Figure 1:
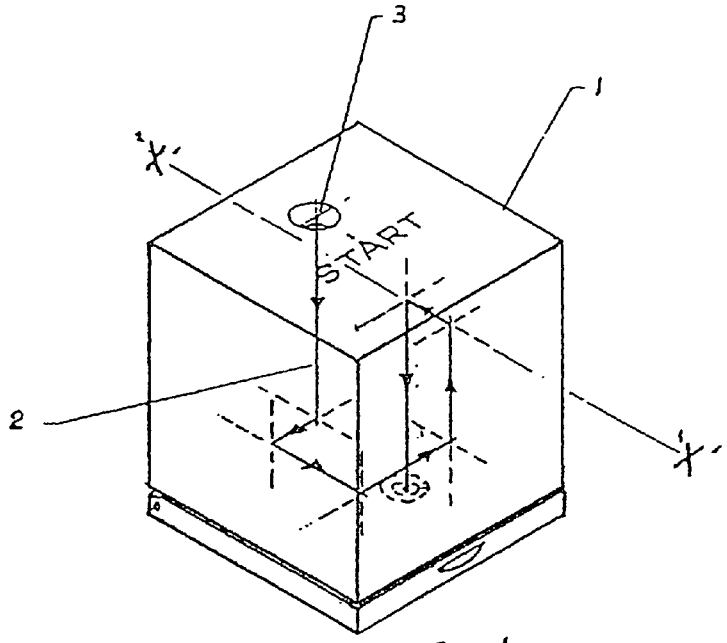

| | | | | | |
|---|---|---|---|---|---|
| 5,560,606 | A * | 10/1996 | David | 273/153 R | |
| 6,568,679 | B1 * | 5/2003 | Sommer | 273/153 R | |
| 2002/0125634 | A1 * | 9/2002 | Roy | 273/118 R | |
| 2006/0012119 | A1 * | 1/2006 | Guha | 273/153 R | |

FOREIGN PATENT DOCUMENTS

| | | |
|---|---|---|
| WO | WO9219338 | 11/1992 |

* cited by examiner

THREE DIMENSIONAL MAZE GAME

FIELD OF THE INVENTION

The present invention relates to a three-dimensional maze game in the form a hand held toy. The maze game is hereafter referred to hand held toy. The hand held toy is in the form of a cube. An object is inserted into an entry point in the toy and the player has to bring the object out through an exit point by following a fixed number of steps in turning the toy. The challenge is to find the correct sequence of turns and considerable amount of mental dexterity is required for the purpose.

BACKGROUND OF THE INVENTION

Numerous maze games are known which require various degrees of physical skill in order to move an object from the entry to the exit point. Many of the known mazes are in the form of tortuous channels or passageways in two/three-dimensions through which an object viz. marble has to be guided from the start to the end point. The toys are generally transparent in order to make the pathways visible to the player who has to guide the object/marble by selecting a path by proper orientation of the maze.

U.S. Pat. No. 2,509,340 relates to a puzzle of the maze ball type wherein a maze is provided, having an entrance and an exit and a torturous path therebetween, through which a ball is adapted to be passed, a plurality of false paths also being provided. The maze is adapted to be contained in a transparent sphere such that the moving object/ball in the maze is visible to the payer at all times. The sphere is constructed of two hemispheres with the pathways suitably moulded. Thereafter, the hemispheres are assembled by aligning the pathways and sealing the device. Conversely, the pathways may be drilled subsequent to the formation of the device from the exterior of the device and their ands suitably sealed with plastic.

U.S. Pat. No. 3,406,971 teaches a novel three-dimensional labyrinth employing a moving ball dimensioned to ride within configured slots in stacked transparent sheets maintained in a fixed array. The device consists of a plurality of planar elements, each having one or more slots therein which when stacked, form an organized pattern through which a movable member, such as a ball, may move. The ball is guided by the sides of the slot while being maintained at its vertical reference level by the underlying planar element. The maze complexity may be increased by false routes. The player has to tilt the device in order to guide the object through the slots. Because of the gap between the planar elements and their relative thinness, the object is visible from two sides and helps in the game.

U.S. Pat. No. 4,005,865 teaches a three-dimensional amusement device comprising a hollow transparent container. The container is wrapped, in a multitude of bends and directions, a hollow, transparent tube joined at its ends by a joining plug, thereby forming a continuous, multi-planar three-dimensional passageway network located entirely within the container. The joining plug is marked to indicate start and finish, and forms a carrier in the passageway. Within the passageway is located a small bead of mercury capable of moving as a bead through the continuous passageway from one end of the plug to the other. The object of the amusement is to tilt the container in such a fashion as to work the mercury bead from one end of the plug to the other via the continuous passageway. The player, while looking at the transparent pathway and the mercury bead has to use his physical dexterity and guide the bead through the complete stretch of the pathway. There are no false paths but the complexity of the game may be increases by increasing the number of bends in the pathway.

U.S. Pat. No. 4,008,895 teaches of a maze having substantially coextensive walls one of which forms an inner three-dimensional form or shell and the other which forms an outer form or shell. Each of the shells is generally in the form of a cube and the inner shell is fixedly positioned within the outer shell so as to maintain a predetermined, uniform distance between the inner and outer walls. The outer wall is formed with a network of channels which, together with the inner wall, define a corresponding network of passageways. The passageways on each side of the outer cube are connected to the passageways on the adjacent sides of the cube so as to form interconnected passageways which permit one or more marbles, for example, to move through the passageways on one or more sides of the cube with changes in orientation of the maze in space. Apertures are provided in at least one passageway on each side of the cube for providing points of entry and exit for the marbles into and out of the maze. By selective changes in orientation of the maze in space marbles within the maze can be made to move through the passageways without escaping through the apertures. By using a transparent outer shell, all the marbles contained within the maze may be readily observed prior to reorientation of the maze.

An important feature of U.S. Pat. No. 4,008,895 which substantially facilitates the assembly of the maze game once the individual panels have been molded or formed, is the provision of corner portions at each of the above described channel free ends, which corner portions are dimensioned and adapted to snappingly engage with one another so as to eliminate the need of additional connecting means for joining the panels or walls to each other. As best shown in there are provided two differently sized corner portions, namely wide corner portions and narrow corner portions. The wide corner portions are extensions of the respective channel free ends, as to be described, and define ninety degree bends in the connected channels to permit the marbles, for example, to move between associated channels formed on opposite sides of the maze by being deflected by ninety degrees during such transition of sides.

U.S. Pat. No. 4,494,753 relates to a transparent enclosed cube containing a maze constructed of a plurality of layers of parallel square tubes separated by other layers of parallel square tubes, each tube having at least one opening to a neighboring tube, entrance opening to insert a ball therein that will traverse the maze to an exit opening by gravity when the cube is manipulated about its three axes. The ball may be made with a resilient surface and the entrance opening may be smaller than the other tube openings so the ball must be squeezed through the entrance. Thus the pathway may be changed by a different arrangement of the square tubes. False paths are automatically formed as the tubes have apertures that lead to the next parallel tube and while playing if the aperture is missed, the ball will be trapped inside the tube.

U.S. Pat. No. 5,560,606 teaches a cubicle maze puzzle including a transparent cubicle main portion having an upper end and a lower end. The main portion has transparent walls formed therein. The walls define a plurality of chambers within the main portion. The walls have a plurality of apertures formed therein defining a tortuous path from an entrance point in the upper end to an exit point in the lower end. The device includes a ball that is dimensioned for receipt within the entrance point of the transparent cubicle main portion for traveling though the tortuous path defined by the plurality of apertures to be ejected outwardly through the exit point.

The above mentioned prior art relate to three-dimensional maze where the pathways are visible to the player. The complexity is increased by increasing the number of pathways, bends and false ends. For a successful completion of the games the player has to skillfully guide the object/ball through the pathways from the entry to the exit point. Thus, only physical dexterity is required and the games do not require any strategic skill. Moreover, the maze-games cannot be played in steps, i.e. the total playing process cannot be divided into steps involving a straight pathways so that the player has to think of the next combination or specified movement required in order to guide the ball into the next intersection. Moreover, all the prior arts and difficult to make, involving complicated segments and are expensive to manufacture.

U.S. Pat. No. 4,545,577 teaches a maze game device for moving one or more game objects from a starting position to a finish position which includes a housing enclosing a plurality of tunnels which are movable in location within the housing in response to the depressment of buttons which extend outwardly from various locations on the housing and the concurrent tilting and orienting of the housing. The game object or objects are maneuverable from the starting location to the finish location by orientating the housing and depressing the buttons either singly or in combination to align the tunnels to provide a path for moving the game object from the starting location to the finish location. One or more game objects are allowed access into the housing through one or more openings in the housing by the depressment of the particular game control which aligns a tunnel directly beneath the opening in the housing. The game piece is then maneuvered through the housing by means of both depressing a game control or a combination of game controls and tilting and orientating the housing in different positions to cause the tunnels to provide a path for the game object to a desired location and to cause the game objects to then follow that path. The game thus contains mechanical means to accentuate buttons and the construction of the same is complicated.

U.S. Pat. No. 4,861,036 teaches a multi-level crossing maze toy, wherein nine kinds of single cubes of the same size in the number as desired are combined longitudinally, laterally and thicknesswise to form a combined cube, the combined cube being formed in two surface thereof with an entrance and an exit open thereto, opening of the cube are singly associated when the combined cube is formed, and a dead end passage, a linear passage, a curved passage, a T-passage, a right-angle three-forked passage, a cross passage, a five-forked passage and a six-forked passage formed interiorly of a single cube are freely placed in communication with one another to form a multi-level crossing maze. Therefore, a ball is introduced into the multi-level crossing maze from the entrance of the combined cube to which is connected the single cube, and the combined cube is operated to move the ball and remove it from the exit. The present invention provide means in which a complicated maze invisible from outside is formed interiorly of a combined cube or a complicated maze a part or whole of which can be seen through from the out side is formed so that one may remind of the structure of the maze and pleasantly naturally learn the brain judgement, thinking power and patience.

U.S. Pat. No. 4,861,036 teaches a visible maze which is made invisible by placing the same inside an opaque combined cube so that the player has to remember the maze pattern in order to successfully guide the ball through it. The game thus requires a good memory to play but does not require strategic or combination skills. Moreover, the smooth pathways will always lead the ball to the end of the vertically aligned pathway and a certain amount of physical skill is required to guide the ball into the desired pathway from an intersection. Ultimately, the movement of the ball will depend on the physical skill of the player. Additionally, the maze pathway is created by a plurality of cubes and these cubes have to be combined in order to define the pathway. Thus, it is also expensive to manufacture.

OBJECTS OF THE INVENTION

Thus the object of the present invention is to provide a toy comprising a three-dimensional maze which requires considerable amount of mental and strategic skill to play.

Another object of the present invention is to provide a toy that will be easy to construct and thus will be less expensive to manufacture.

A further object of the present invention is to provide a toy that will be hand held and does not require physical skill to play but success would entirely depend on the mental skill and of the player.

Yet further object of the invention is to provide a toy that can be played in steps, wherein completion of every step will require mental skills and only a correct sequence of steps will lead to success.

Yet another object of the invention is to provide a toy which can act as an educational tool to improve one's intelligent quotient (IQ).

SUMMARY OF THE INVENTION

Thus according to the present invention it is provided a three-dimensional maze game in the form of a hand-held toy comprising:

a substantially cubic non-transparent body containing a plurality of intersecting pathways for an object and an entrance aperture and single/multiple exit apertures connecting the pathways wherein each intersection formed by the said intersecting pathways is provided with means to bring the said object to rest till the toy is tilted and the object follows a vertical pathway that is defined by the tilting of the toy.

DETAILED DESCRIPTION OF THE INVENTION

The hand held toy of the present invention comprises a cube with a three-dimensional maze. It has an entrance aperture and single or multiple apertures connecting the pathways. The plurality of pathways intersects where there are false pathways. Preferably, each intersection has two pathways leading to the next intersection and three false pathways. All the pathways are either parallel or perpendicular to each other. Each intersection is provided with a cavity facing the pathway leading to the entrance point. The cavity prevents the object from further rolling when it reaches the intersection. Now, by tilting the cube to any four of the possible ways so as to rest the cube on any four of the adjacent sides, the object can be made to follow any one of the four pathways originating from the intersection. If the wrong pathway is chosen, the object will enter a blind lane. Only when the right pathway is chosen by tilting the toy to the corresponding side, the object will move to the next intersection and stop there due to another similar cavity at the intersection. Similarly, by the right choice of the side the object can be successfully guided to the exit point.

DESCRIPTION OF THE PREFERRED EMBODIMENTS

The invention will now be described with reference to a non-limiting embodiments of the toy shown in the figures of the drawings, in which FIG. 1 shows a three-dimensional drawing of the toy comprising a cube where a thick line shows the centerline of the principal pathway.

Figure 2A:
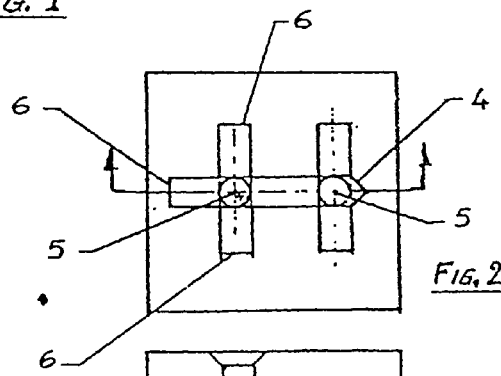
Figure 2B:
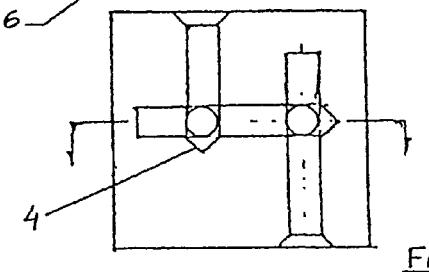

FIGS. 2*a* & 2*b* are views of typical pathway-intersections.

Figure 3:
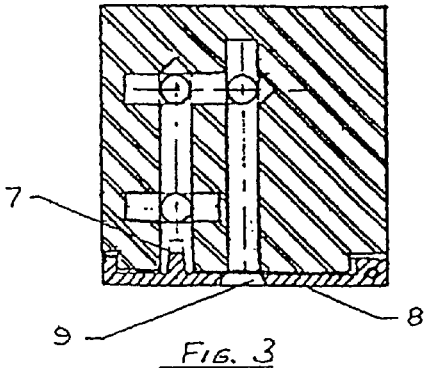

FIG. 3 is the cross-sectional view along X-X in FIG. 1.

Figure 4A:
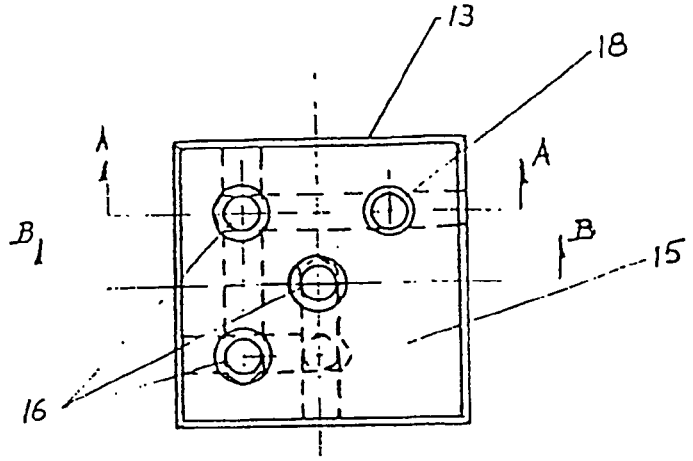

FIG. 4*a* is the top view of another embodiment with top cover removed.

Figure 4B:
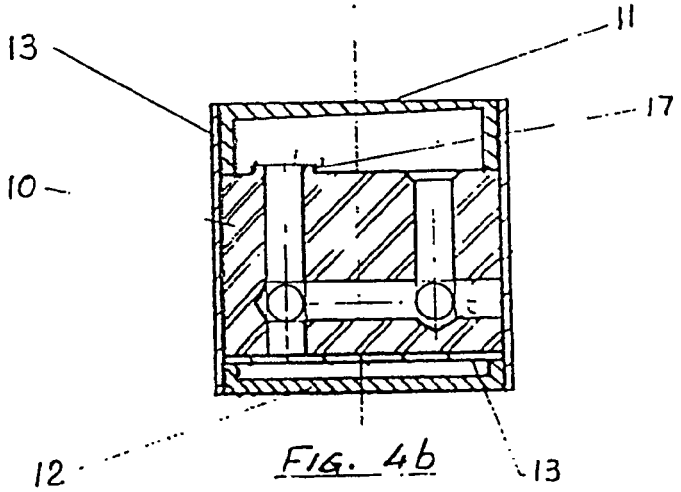

FIG. 4*b* is a sectional view through the entry hole of the embodiment shown in FIG. 4*a*.

Figure 4C:
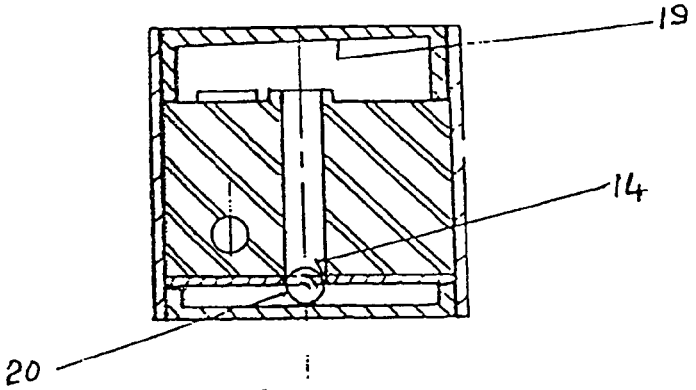

FIG. 4*c* is a sectional view through the exit hole of the embodiment shown in FIG. 4*a*.

Figure 5A:
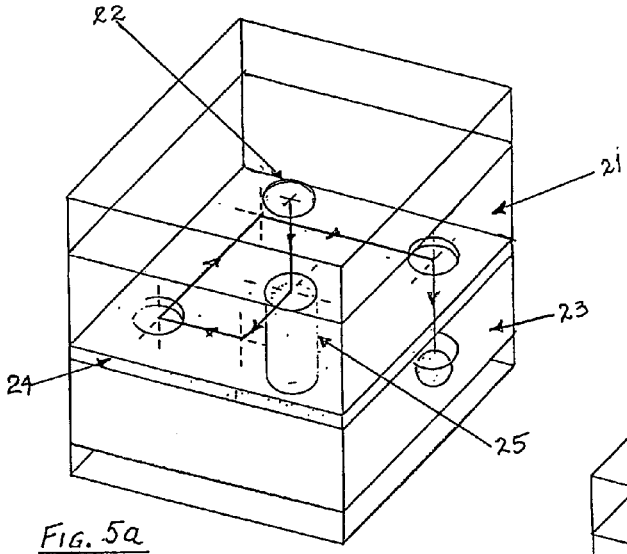
Figure 5B:
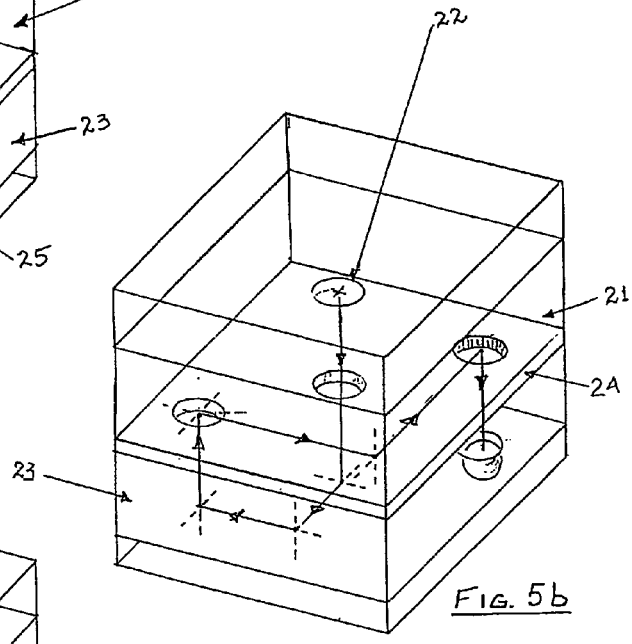
Figure 5C:
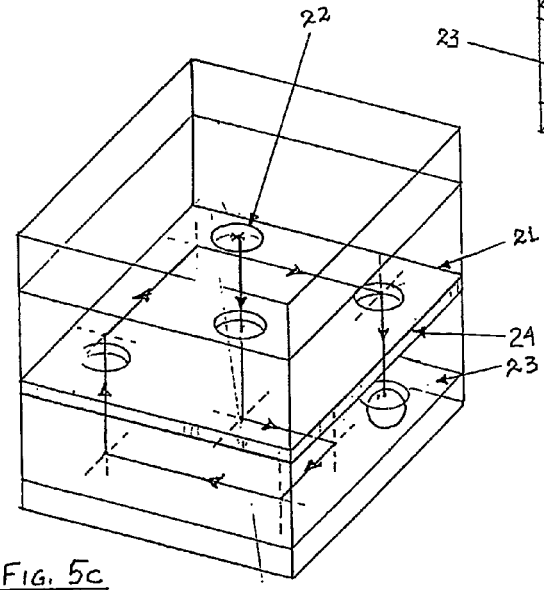

FIGS. 5*a*, 5*b* and 5*c* show three variations of the pathway.

FIGS. 1, 2*a*, 2*b* & 3 describe a preferred embodiment of the present invention. The toy comprises a cube (1) with the entry and exit points at opposite ends. At the beginning of the game, the cube rests on the side having the exit point and the side with the entry hole (3), marked "START" facing up. A ball of correct size is dropped through the entry hole and it comes to rest at the conical end (4) just after passing a four-way crossing (5) where four paths direct towards four sides as rights angles to the vertical path are located. The position of the conical end is such that a ball resting on it will not roll until the cube is further tilted to any one of the four adjacent sides. The conical end is centrally located at the intersection so that the ball will roll to that path of the four-way crossing towards which the cube is tilted and the path becomes vertical. Out of the four paths originating from the intersection (excluding the pathway from the entry point), three paths (6) end as blind lanes and only one hole continues towards another four-way crossing ending with a conical end after passing the crossing. In FIG. 1 the broken lines at the crossing represent the blind lanes whereas the solid line (2) with arrow-heads shows the path that if followed will lead to the exit hole ultimately. The ball will follow the solid line only when the cube is rolled with correct side down. If the ball ends in a blind lane for not following the correct sequence then it will not come out through the exit hole. If it is held up at the first crossing, it will be visible through the entry hole when at start position. If it is held up at some other crossing then the cube must be shaken back and forth and side to side keeping it resting with the entry hole up. This will allow the ball to drop into one of the vertical holes and come to the rest on top of the plug (7) of the bottom plate (8) hinged to the main body (1). All vertical holes directed downwards when the cube is in the start position, except the exit hole (9) are plugged by the projections on the bottom plate. By unsnapping the bottom plate and tilting it the ball can be retrieved for further attempts. The sides of the cube can be covered with plates of different colours to help in playing the game and finding the solution quickly.

Another embodiment of the present invention is illustrated by the FIGS. 4*a*, 4*b* & 4*c*. FIG. 4*a* is the top view with top cover removed and 4*b* & 4*c* two cross-sections views, one through the entry hole and another through the exit hole. In this embodiment the core piece (10) is shown as a simple molded piece having the pathways with intersections where each hole has an opening at least from one side so that the pathway can be molded easily. There are two transparent caps, one (11) at the top entry end and the other (12) at the bottom exit end. All the sides except the top surface is covered with different coloured plates (13) to close all the holes opening except the exit hole (14) at the bottom surface. The top surface 15 has three escape holes (16) with raised bosses (17), besides the entry hole (18). If after the player completes all the steps and finds the ball remaining entrapped inside because of one or more faulty steps, the whole body is to be set down with the top side down and shaken back and forth and sideways which will make the ball come out through one of the escape holes (16) and come to rest on the inside surface (19) of the top cover. This surface slopes towards one edge to keep the ball away from the escape hole openings so that the ball will not drop accidentally through them when the cube body is turned over, topside up, to start the game. Since the entry hole do not have a boss around it, just by tilting the ball can be made to enter it. The specialty of this version of the embodiment is that the ball (20) never escapes the body and even when it comes out of the exit hole it stays inside the bottom cover partially out of the hole being visible to indicate successfully completion of the game. To make the success more noticeable, the ball when it comes out of the exit hole may connect two terminals of an electric circuit consisting of a battery and a bulb. This lighted bulb can also be used in making the coloured plates glow if they were made of translucent plastic material.

According to another preferred aspect of the invention the cube may be manufactured by assembling three separate bodies which are so provided that by proper selection of the orientation of the three bodies and/or positioning one or more pegs at selected locations, toys having different levels of complexity of the pathway can be manufactured. With a single design of the three bodies, three or more variations of the pathway can be achieved. The assembling of the toy by joining different parts adds to the ease in manufacture and also incorporates the capability of changing the pathway resulting in different variations of the toy with the same three pieces.

According to the above preferred embodiment, the whole pathway is split into two separate bodies, top and bottom with an intermediate separating wall with connecting holes between two track-bodies at strategic locations. The start hole is located at the center of the top track-body for maximum flexibility. The exit hole is located at one corner of the bottom track body. It is to be noted that by proper relative disposition of the three bodies and by placing plugs at strategic positions in the tracks, the ball can be made to travel towards each side (under gravity) a specific number of times before reaching the exit hole.

FIGS. 5*a*, 5*b* and 5*c* represent three variations in the pathway which is possible with the same three bodies. The degree of complexity of the toy is progressive in the said embodiments and referred to as Levels I, II and III respectively defining ascending order of complexity.

In each of the embodiments shown in FIGS. 5*a*, 5*b* and 5*c*, there is provided a top track body (21) with start hole (22), a bottom track body (23) and an intermediate separating wall (24) which are assembled in pre-determined orientations to achieve the variations.

In FIG. 5*a*, the central hole is plugged with a plug (25) so that the ball cannot reach the bottom track at start and is made to travel towards each side, once only, while being restricted in the top track before reaching through the connecting hole to exit hole located at one corner of the bottom track. Thus in the Level I version, minimum number of steps required to complete the game is 'start' plus 5. In FIG. 5*b*, the central plug is removed thus allowing the ball to drop down to the lower track at start. By using plugs on the bottom track the ball is made to move towards the sides specific number of times before directed towards the top layer through a connecting hole at the separating casing wall, then the ball is made to move towards rest of the sides before directed down through another connecting hole to the exit hole. In this Level II version minimum number of steps required to complete the game successfully is 'Start' plus 6. Similarly in FIG. 5*c* the ball is made to travel towards one side twice, once in the bottom track and again once more while at the top track. Thus in this version, Level III, minimum number of steps needed for successfully completing the game is 'Start' plus 7. It is possible to make the game more difficult to solve by making the ball to travel twice towards more sides.

Thus by introducing two or more levels of same embodiments this game caters to all age groups, and allows graduation from Level I to Level II and so on, improving individual concentrating power, memory and analytical skill. Thus as a set of two or more, this hand-held toy becomes an educational tool to improve intelligent quotient (IQ).

I claim:

1. A three-dimensional maze game in the form of a hand-held toy, comprising:

a substantially cubic non-transparent body containing a plurality of intersecting pathways of varying lengths for an object; and an entrance aperture and one or more exit apertures connecting the pathways;

wherein each intersection formed by said intersecting pathways is provided with means to bring the said object to rest till the toy is tilted and the object follows a vertical pathway that is defined by the tilting of the toy;

wherein at least one or more pathways lead to at least a blind pathway; and wherein said exit aperture comprises two terminals of an electrical circuit.

2. A three-dimensional maze game according to claim 1, wherein said means is a substantially conical/cuboidal cavity.

3. A three-dimensional maze game according to claim 2, wherein said cavity faces the pathway leading to the entrance aperture.

4. A three-dimensional maze game according to claim 1, wherein each said pathway leads to three blind pathways and two other pathways leading to the next intersection.

5. A three-dimensional maze game according to claim 1, wherein the pathways are moulded inside the body.

6. A three-dimensional maze game according to claim 5, wherein said entrance aperture and the said exit aperture are located at opposite sides of the body.

7. A three-dimensional maze game according to claim 5, wherein the said body comprises a bottom plate hinged to said body.

8. A three-dimensional maze game according to claim 1, wherein said body comprises an entrance aperture and a single exit aperture.

9. A three-dimensional maze game according to claim 1, wherein said body comprises an entrance aperture and multiple exit apertures.

10. A three-dimensional maze game according to claim 9, wherein one of said multiple aperture is located at the opposite side of the entry aperture and the rest of said multiple apertures are located on the same side of the entry aperture.

11. A three-dimensional maze game according to claim 10, wherein said rest of the exit apertures have raised bosses.

12. A three-dimensional maze game according to claim 1, wherein said electrical circuit comprises a battery and a bulb.

13. A three-dimensional maze game according to claim 1, wherein the terminals are adapted such that said bulb glows when the object comes out of the exit aperture.

14. A three-dimensional maze game according to claim 1, wherein said toy is made of non-transparent plastic material.

* * * * *